US009455518B2

(12) United States Patent
Hasegawa et al.

(10) Patent No.: US 9,455,518 B2
(45) Date of Patent: Sep. 27, 2016

(54) CONNECTOR HAVING REGULATING SECTION

(71) Applicant: YAZAKI CORPORATION, Tokyo (JP)

(72) Inventors: Hirotaka Hasegawa, Shizuoka (JP); Shinya Oishi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/783,177

(22) PCT Filed: Mar. 28, 2014

(86) PCT No.: PCT/JP2014/059369

§ 371 (c)(1),
(2) Date: Oct. 8, 2015

(87) PCT Pub. No.: WO2014/168035

PCT Pub. Date: Oct. 16, 2014

(65) Prior Publication Data

US 2016/0036154 A1 Feb. 4, 2016

(30) Foreign Application Priority Data

Apr. 8, 2013 (JP) ..... 2013-080726

(51) Int. Cl.

*H01R 13/40* (2006.01)
*H01R 13/04* (2006.01)
*H01R 43/20* (2006.01)

(Continued)

(52) U.S. Cl.

CPC ..... *H01R 13/40* (2013.01); *H01R 13/04* (2013.01); *H01R 43/20* (2013.01); *H01R 9/22* (2013.01); *H01R 13/41* (2013.01)

(58) Field of Classification Search

USPC ..... 439/733.1, 752.5

See application file for complete search history.

(56) References Cited

U.S. PATENT DOCUMENTS 5,609,503 A * 3/1997 Tsuji ..... H01R 13/4362 439/733.1
5,653,613 A * 8/1997 Shimoda ..... H01R 13/4361 439/752
6,165,027 A * 12/2000 Huang ..... H01R 13/41 439/733.1

(Continued)

FOREIGN PATENT DOCUMENTS

JP 55-11715 U 1/1980
JP 1-109179 U 7/1989

(Continued)

OTHER PUBLICATIONS

International Preliminary Report on Patentability and English language Written Opinion of the International Search Report for PCT/JP2014/059369.

(Continued)

*Primary Examiner* — Tho D Ta
(74) *Attorney, Agent, or Firm* — Kenealy Vaidya LLP

(57) ABSTRACT

There is provided a connector including a terminal which is provided with an electrical connection section with a tab shape that is provided with a raised part which extends along a terminal fitting direction, and a connector housing which is provided with a terminal accommodating chamber that accommodates the terminal, and an insertion hole through which the electrical connection section is inserted in the terminal accommodating chamber and protrudes outward.

7 Claims, 7 Drawing Sheets

(51) Int. Cl.
*H01R 13/41* (2006.01)
*H01R 9/22* (2006.01)

(56) References Cited

U.S. PATENT DOCUMENTS

| | | | | |
|---|---|---|---|---|
| 6,174,208 | B1 | 1/2001 | Chen | |
| 6,261,132 | B1 * | 7/2001 | Koseki | H01R 13/41 439/733.1 |
| 6,302,748 | B1 * | 10/2001 | Xu | H01R 13/41 439/751 |
| 2008/0124980 | A1 * | 5/2008 | Lappoehn | H01R 13/50 439/660 |

FOREIGN PATENT DOCUMENTS

| | | |
|---|---|---|
| JP | 2-14135 Y2 | 4/1990 |
| JP | 3224369 B2 | 8/2001 |

OTHER PUBLICATIONS

International Search Report for PCT Patent App. No. PCTJP2014/059369 (Jun. 3, 2014).

Japanese Office Action for the related Japanese Patent Application No. 2013-080726 dated Jul. 8, 2016.

* cited by examiner

CONNECTOR HAVING REGULATING SECTION

TECHNICAL FIELD

The present invention relates to a connector.

BACKGROUND ART

FIG. 9 illustrates a structure of a terminal which is indicated in PTL 1 to be described below.

A terminal 100 which is manufactured using a metal plate is provided with a raised part 103 on both sides of an electrical connection section 101 which is formed in a tab shape. Since the raised part 103 is provided in order to secure strength and thickness, the raised part 103 is raised in the plate thickness direction of the electrical connection section 101 (the arrow X1 direction in FIG. 9), and extends along the terminal fitting direction (the arrow Y1 direction in FIG. 9).

CITATION LIST

Patent Literature

[PTL 1] JP-UM-A-1-109179

SUMMARY OF INVENTION

Technical Problem

Here, when the connector which is provided with the terminal described above is fitted with a female screw which is accommodated in a counterpart connector, a configuration is required for suppressing looseness of the terminal such that terminals do not collide with each other due to the looseness of an accommodated terminal. On the other hand, in order to reduce manufacturing costs, simplification of structure of a terminal accommodating chamber is required.

Therefore, relating to solving the problem described above, an object of the present invention is to provide a connector which is able to suppress looseness of a terminal, and moreover, is able to achieve a reduction of manufacturing costs by simplifying the structure when the terminal, which is provided with an electrical connection section with a tab shape that is provided with a raised part which extends along the terminal fitting direction, is accommodated in a terminal accommodating chamber.

Solution to Problem

The object of the present invention described above is achieved using the configuration below.

(1) A connector comprising:

a terminal including an electrical connection section which has a tab shape and is fitted to a terminal of a counterpart side connector so as to be electrically connected thereto; and a connector housing including a terminal accommodating chamber which accommodates the terminal, and a terminal insertion hole through which the terminal is inserted and protrudes into the terminal accommodating chamber, wherein the electrical connection section has a raised part which extends along a fitting direction with the counterpart side connector at a location protruding from the terminal insertion hole, and is raised in a plate thickness direction of the terminal, and a regulating section, which protrudes from a location not facing the raised part toward an opposite side with respect to the raised part in a raised direction of the raised part, is integrally formed in a peripheral edge of the terminal insertion hole positioned at a raised side of the raised part in the raised direction.

(2) The connector according to (1) described above, the regulating section has a planar part facing a surface of the electrical connection section except for the raised part.

According to the configuration described above in (1), when the terminal which has an electrical connection section with a tab shape that is formed with the raised part which extends along the terminal fitting direction is inserted into the terminal insertion hole which is formed in the terminal accommodating chamber of the connector housing, looseness is regulated by the regulating section which is provided in the terminal insertion hole. For this reason, it is possible to suppress looseness of the terminal. Accordingly, it is possible to facilitate a fitting operation of the terminal inside the terminal accommodating chamber and a counterpart terminal.

In addition, since the regulating section is integrally formed in the terminal insertion hole, the number of components does not increase. Furthermore, the regulating section has a structure so as to protrude from a location which does not face the raised part toward the opposite side in the raised direction of the raised part on a peripheral edge which is positioned in the raised direction of the terminal insertion hole. For this reason, it is possible not only to avoid complication of the structure in the connector housing, but also to achieve a reduction in manufacturing costs by simplifying the structure.

According to the configuration described above in (2), since the electrical connection section is regulated by a planar part of the regulating section, a stable posture is held without tilting.

Advantageous Effects of Invention

According to the connector in the present invention, it is possible to suppress looseness of a terminal, and moreover, it is also possible to achieve a reduction in manufacturing costs by simplifying the structure when the terminal, which is provided with a raised part that extends along the terminal fitting direction, is accommodated.

The present invention is described simply above. Furthermore, the details of the present invention are further defined by reading of embodiments for carrying out the invention (hereinafter referred to as "embodiments") which will be described below with reference to the attached drawings.

DESCRIPTION OF EMBODIMENTS

A preferred embodiment of a connector according to the present invention will be described in detail with reference to the drawings.

Figure 1:
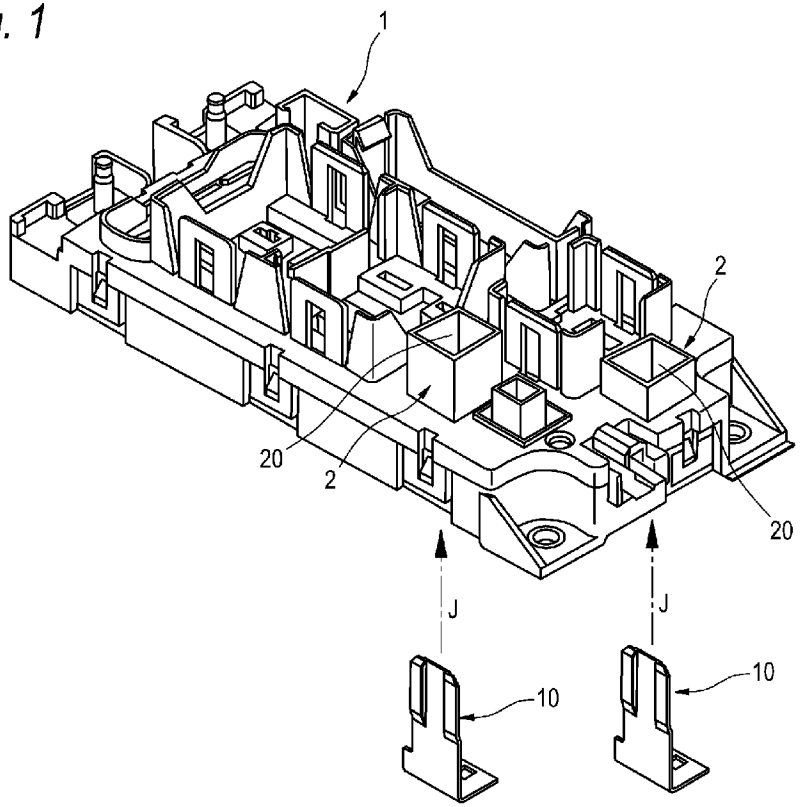
FIG. 1 is a perspective view of an embodiment of an electric junction box which has a connector according to the present invention.
Figure 2:
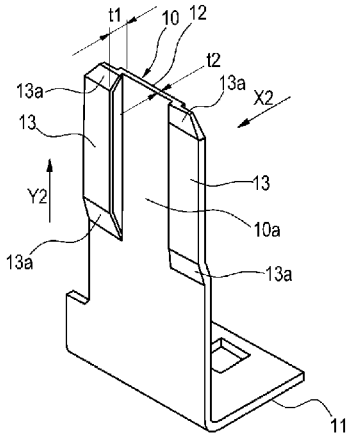
FIG. 2 is an enlarged perspective view of the terminal which is illustrated in FIG. 1.
Figure 3:
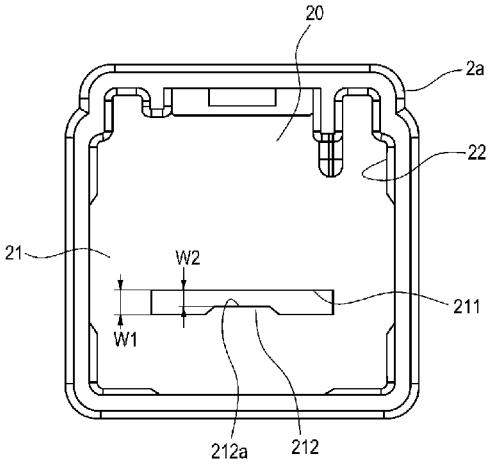
FIG. 3 is a front surface view of a terminal accommodating chamber which is provided in the electric junction box in FIG. 1.
Figure 4:
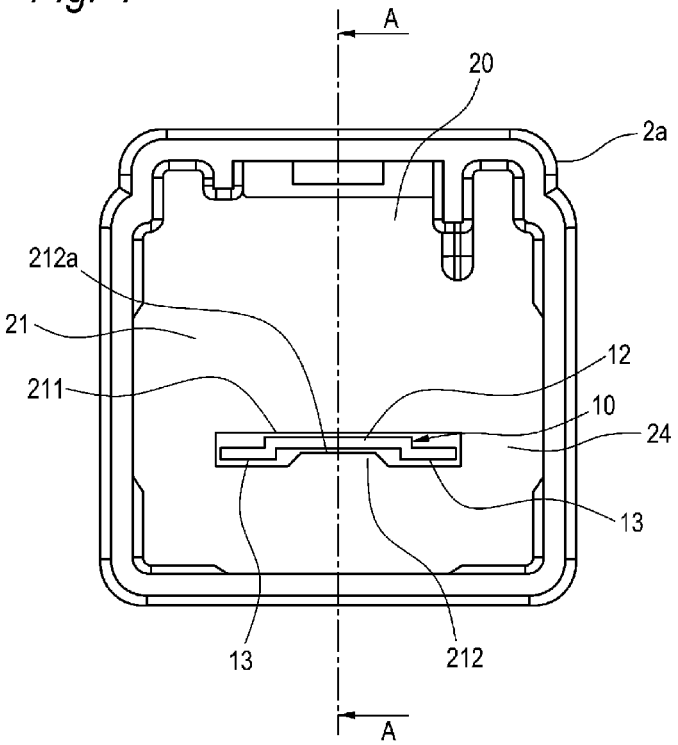
FIG. 4 is an explanatory view of a state in which the terminal which is illustrated in FIG. 2 is inserted into the terminal accommodating chamber which is illustrated in FIG. 3.
Figure 5:
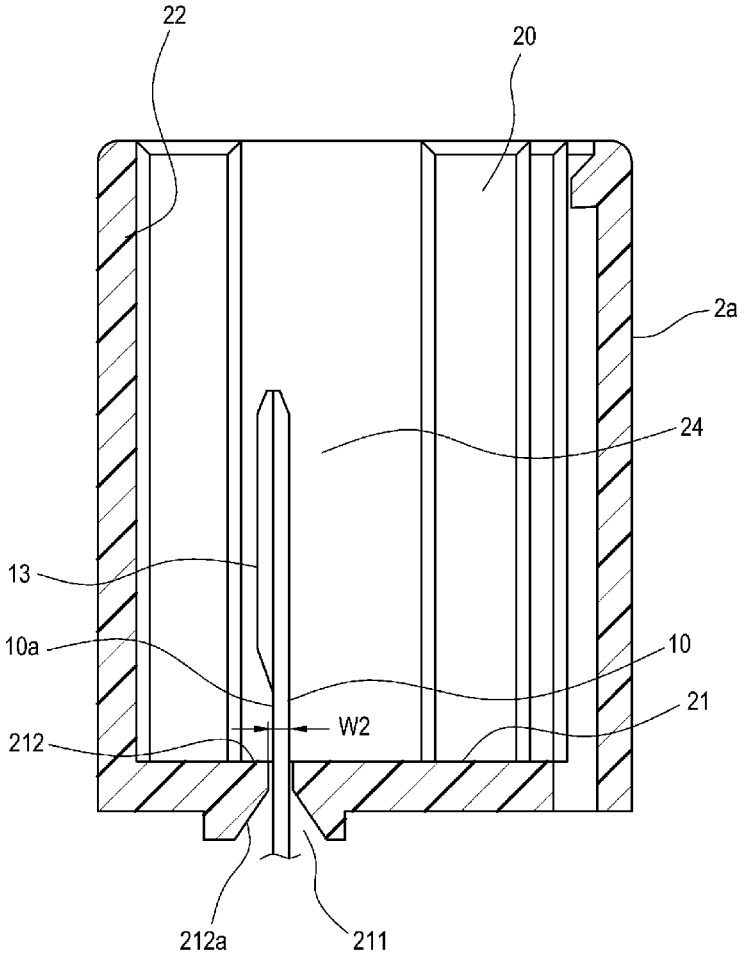
FIG. 5 is a sectional view taken along line A-A in FIG. 4.

FIGS. 1 to 5 indicate an embodiment of a connector according to the present invention. FIG. 1 is a perspective view of an embodiment of an electric junction box which has a connector according to the present invention, FIG. 2 is an enlarged perspective view of the terminal which is illustrated in FIG. 1, FIG. 3 is a front surface view of a terminal accommodating chamber which is provided in the electric junction box in FIG. 1, FIG. 4 is an explanatory view of a state in which the terminal which is illustrated in FIG. 2 is inserted into the terminal accommodating chamber which is illustrated in FIG. 3, and FIG. 5 is a sectional view taken along line A-A in FIG. 4.

An electric junction box 1 which is illustrated in FIG. 1 is disposed between a vehicle battery and the wire harness and bears a connection of a wire harness to a connector, and a connection of a fuse and the like to a wire harness.

The electric junction box 1 is manufactured using resin and a connector 2 that has a terminal accommodating chamber 20 which accommodates a terminal 10 made from metal at two location on the upper surface, is integrally formed therein.

The terminal 10 is formed in a shape so as to be provided with an electrical connection section 12 with a tab shape that is raised up vertically from one edge of a base plate section 11 which is connected to a circuit at the rear side of the electric junction box 1. As shown by arrow J illustrated in FIG. 1, the terminal 10 is inserted into the terminal accommodating chamber 20 from the rear side of the electric junction box 1. As shown in FIG. 2, the terminal 10 in the present embodiment is provided with a raised part 13 on both side edges of the terminal 10 in the width direction. The raised part 13 is formed by press forming in a shape which is raised in the plate thickness direction (the arrow X2 direction in FIG. 2) of the terminal 10, and extends along the terminal fitting direction (the arrow Y2 direction in FIG. 2). In addition, either of the leading end side and the rear end side of the raised part 13 becomes a tapered surface 13*a* in which the raised height changes gradually.

The connector 2 is fittable to a counterpart connector, which is not shown in the drawings, that is connected to a wire harness. By the counterpart connector being fitted to the connector 2, a female terminal inside the counterpart connector is fitted to the terminal 10 inside the terminal accommodating chamber 20.

As shown in FIG. 3, in the connector 2 of the present embodiment, the terminal accommodating chamber 20 which is provided in a connector housing 2*a* is formed by an accommodating chamber bottom wall 21 and a cylindrical accommodating chamber side wall 22 which is raised from the periphery of the accommodating chamber bottom wall 21.

A terminal insertion hole 211 into which the terminal 10 is inserted is formed in the accommodating chamber bottom wall 21. In addition, in the case of the present embodiment, a regulating section 212 is integrally formed in the accommodating chamber bottom wall 21. The regulating section 212 has a structure in which a portion of a peripheral edge of the terminal insertion hole 211 protrudes toward the surface of the terminal 10 that is separated from the raised part 13. The surface of the terminal 10 that is separated from the raised part 13 is the surface of a region 10*a* which is positioned between a pair of raised parts 13. That is, the regulating section 212, which protrudes from the location which does not face the raised part 13 toward the opposite side of the raised part 13 in the raised direction on a peripheral edge which is positioned in the raised direction of the raised part 13, is integrally formed in the terminal insertion hole 211. The regulating section 212 is provided with a planar part 212*a* which faces a surface of the electrical connection section 12 except for the regulating section 13 (the surface of the region 10*a*).

As shown in FIG. 3, due to the terminal insertion hole 211 being provided with the regulating section 212, an opening width W1 is large at both side portions of the hole into which the raised part 13 is inserted, and an opening width W2 is smaller than the opening width W1 on both side portions of the hole at center portion of the hole into which the region 10*a*, which is interposed between the pair of raised parts 13 and 13 of the terminal 10, is inserted.

The opening width W1 at both side portions of the terminal insertion hole 211 is set to be slightly larger than a thickness dimension t1 (refer to FIG. 2) in the raised part 13 such that it is possible to smoothly insert the raised part 13. In addition, the opening width W2 at the center portion of the terminal insertion hole 211 is set to be slightly larger than a thickness dimension t2 (refer to FIG. 2) in the center portion of the terminal 10 such that it is possible to smoothly insert the center portion of the terminal 10.

As shown in FIG. 4, the regulating section 212 in the present embodiment protrudes between the pair of raised parts 13 and 13 of the terminal 10 which is inserted into the terminal insertion hole 211, and regulates looseness in the plate thickness direction of the terminal 10 inside the terminal insertion hole 211.

As shown in FIG. 5, in the insertion hole 211, a tapered surface 211*a* is formed on the rear surface side on the opposite side to a space 24 which accommodates the female terminal (not shown in the drawings). For this reason, also in the regulating section 212, the rear surface side thereof becomes the tapered surface 211*a* which guides the terminal 10 which is inserted into the terminal insertion hole 211.

As shown in FIG. 5, the terminal 10 which is inserted into the terminal insertion hole 211 suppresses shaking and tilting in the plate thickness direction of the terminal 10 using the regulating section 212 which protrudes toward the region 10*a* that is positioned between the pair of regulating sections 13.

As shown in FIGS. 4 and 5, the accommodating chamber side wall 22 forms the space 24 which accommodates the female terminal (not shown in the drawings) that is fitted to the terminal 10 on the periphery of the terminal 10 which is inserted into the terminal insertion hole 211.

As shown in FIGS. 4 and 5, in the connector 2 of the embodiment described above, when the terminal 10, which is manufactured using metal and is provided with the raised part 13 that extends along the terminal fitting direction, is inserted into the terminal insertion hole 211 which is formed in the accommodating chamber bottom wall 21, looseness is regulated using the regulating section 212 which is integrally formed in the accommodating chamber bottom wall 21. For this reason, it is possible to suppress looseness of the terminal 10.

In addition since the electrical connection section 12 is regulated by a planar part 212*a* of the regulating section 212 due to the regulating section 212 being provided with the planar part 212*a* which faces a surface of the electrical connection section 12 except for the raised part 13 (the surface of the region 10*a*), a stable posture is held without tilting.

Figure 6:
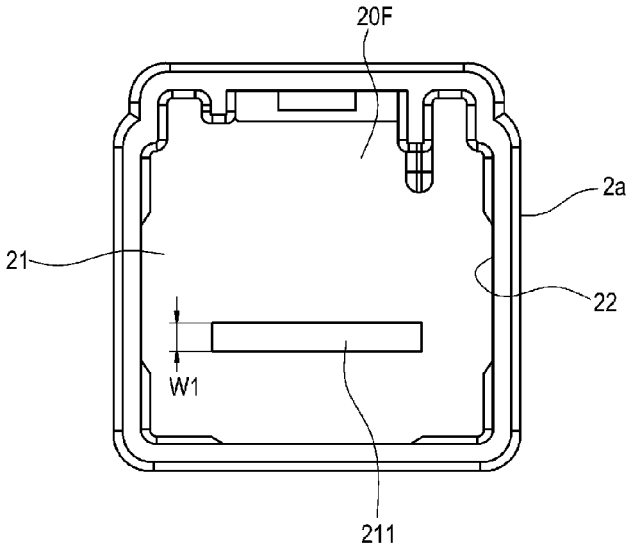
FIG. 6 is a front surface view of a terminal accommodating chamber of a comparative example.
Figure 7:
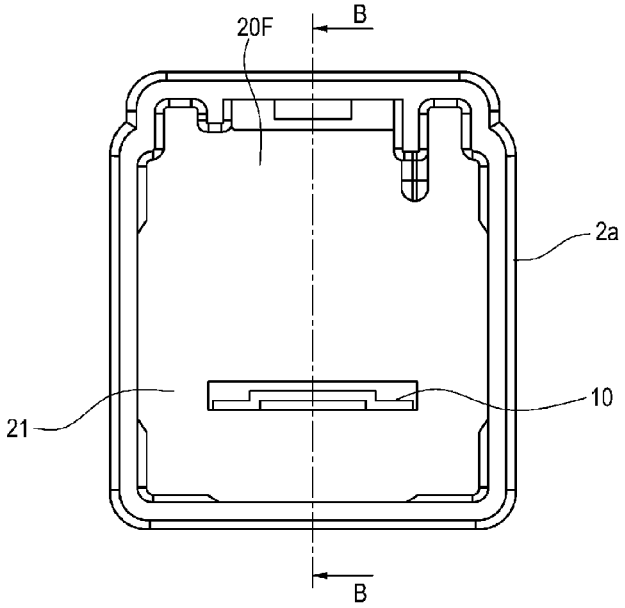
FIG. 7 is an explanatory view of a state in which the terminal which is illustrated in FIG. 2 is inserted into the terminal accommodating chamber which is illustrated in FIG. 6.
Figure 8:
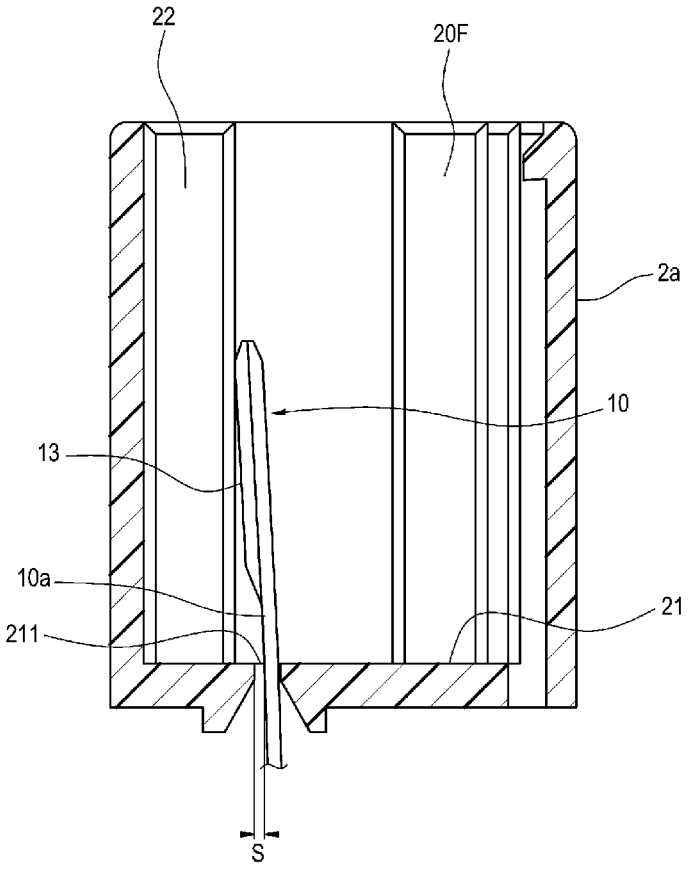
FIG. 8 is a sectional diagram taken along line B-B in FIG. 7.
Figure 9:
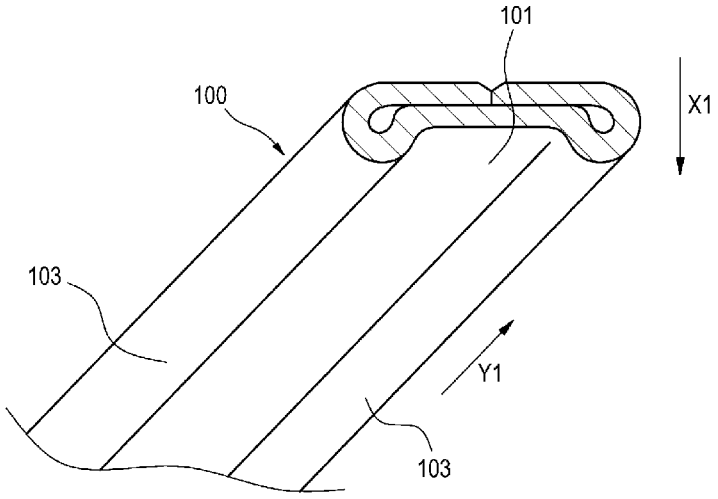
Fig. 9 Related Art
FIG. 9 is perspective view of a leading end side of a terminal of the related art.

Here, a terminal accommodating chamber 20F of a connector is illustrated in FIGS. 6 to 8 as a comparative example. The terminal accommodating chamber 20F of the comparative example omits the shape of the regulating section 212 which is illustrated in the embodiment, and the terminal insertion hole 211 has a simple rectangular shape. In the terminal accommodating chamber 20F of the comparative example, the other configuration of the regulating section 212 is a common configuration with the terminal accommodating chamber 20 of the embodiment, and for the common configuration, the same reference numerals as the embodiment are given and description thereof is omitted.

As shown in FIG. 8, in the terminal accommodating chamber 20F of the comparative example, since the regulating section 212 is not provided, a gap S remains with respect to the region 10*a* of the terminal 10. Then, the gap S permits shaking and tilting in the plate thickness direction of the terminal 10, and a problem occurs in that it is not possible to suppress looseness of the terminal 10.

In addition, in the case of the connector 2 of the embodiment described above, since the regulating section 212 is integrally formed in the terminal insertion hole 211 of the accommodating chamber bottom wall 21, the number of components does not increase. In addition, the regulating section 212 has a structure in which a portion of a peripheral edge of the terminal insertion hole 211 protrudes toward the surface (the region 10*a*) of the terminal 10 that is separated from the raised part 13. For this reason, it is possible to avoid complication of the structure in the connector housing 2*a*, and it is possible to achieve a reduction in manufacturing costs by simplifying the structure.

In addition, in the connector 2 of the embodiment, an opening shape of the terminal insertion hole 211 has an asymmetrical structure in the plate thickness direction of the terminal 10 due to the regulating section 212, which protrudes inside the terminal insertion hole 211, being provided. For this reason, in a case where there is an attempt to insert the terminal 10 into the terminal insertion hole 211 in the incorrect direction, it is also possible to prevent incorrect insertion by insertion itself of the terminal 10 being impossible.

Here, the present invention is not limited to the embodiments described above and appropriate modifications, improvements, or the like are possible. In addition, it is possible to realize the present invention arbitrarily with the materials, form, dimensions, number, arrangement location, and the like of each configuring element in the embodiments described above, but the invention is not limited thereto.

For example, the structure of the connector according to the present invention is not limited to the connector 2 of the electric junction box 1 which is illustrated in the embodiment, and the structure can be applied to various connectors which are provided with the terminal 10.

In addition, the structure of the terminal which is accommodated in the connector according to the present invention is not limited to a structure which has raised parts on both sides. For example, a structure may be provided with one raised part in the center in the width direction of the terminal. In that case, for example, two regulating sections which protrude toward both side edges of the terminal may be integrally formed in the terminal insertion hole.

Here, the characteristics of the embodiment of the connector according to the present invention described above are respectively listed collectively below in for ease of reference.

A connector (2) including a terminal (10) including an electrical connection section (12) which has a tab shape and is fitted to a terminal of a counterpart side connector so as to be electrically connected thereto, and a connector housing (2*a*) including a terminal accommodating chamber (20) which accommodates the terminal (10), and a terminal insertion hole (211) through which the terminal is inserted and protrudes into the terminal accommodating chamber (20), in which the electrical connection section (12) has a raised part (13) which extends along a fitting direction with the counterpart side connector at a location protruding from the terminal insertion hole (211), and is raised in a plate thickness direction of the terminal, and a regulating section (212), which protrudes from a location not facing the raised part (13) toward an opposite side with respect to the raised part in a raised direction of the raised part (13), is integrally formed in a peripheral edge of the terminal insertion hole (211) positioned at a raised side of the raised part (13) in the raised direction.

The connector (2) according to [1] described above, in which the regulating section (212) has a planar part (212*a*) facing a surface of the electrical connection section (12) except for the raised part (13).

The present invention is described in detail or with reference to a specific embodiment, but it is obvious to a person skilled in the art that it is possible to make various changes and modifications without departing from the spirit and scope of the present invention.

The present application is based on Japanese Patent Application (Japanese Patent Application No. 2013-080726) filed on 8 Apr. 2013, the contents of which are incorporated herein by reference.

INDUSTRIAL APPLICABILITY

According to the present invention, it is possible to suppress looseness of a terminal, and moreover, it is possible to achieve a reduction of manufacturing costs by simplifying the structure. The present invention which achieves these effects is useful in the field of connectors.

REFERENCE SIGNS LIST

10 TERMINAL
13 RAISED PART
20 TERMINAL ACCOMMODATING CHAMBER
21 ACCOMMODATING CHAMBER BOTTOM WALL
22 ACCOMMODATING CHAMBER SIDE WALL
24 SPACE
211 TERMINAL INSERTION HOLE
212 REGULATING SECTION

The invention claimed is:

1. A connector comprising:

a terminal including an electrical connection section which has a tab shape and is fitted to a terminal of a counterpart side connector so as to be electrically connected thereto; and a connector housing including a terminal accommodating chamber which accommodates the terminal, and a terminal insertion hole through which the terminal is inserted and protrudes into the terminal accommodating chamber, wherein the electrical connection section has a first surface that lies in a first plane, and a raised part which extends along the first surface in a fitting direction with the counterpart side connector at a location protruding from the terminal insertion hole, the raised part has a plate thickness, and the raised part includes a raised surface that has a width and a length that are each greater than the plate thickness, the raised surface is raised relative to the first surface in a plate thickness direction of the terminal, and the raised surface lies in a raised plane that is substantially parallel to the first plane, and a regulating section, which protrudes from a location not facing the raised part toward an opposite side with respect to the raised part in a raised direction of the raised part, is integrally formed in a peripheral edge of the terminal insertion hole positioned at a raised side of the raised part in the raised direction.

2. The connector according to claim 1, in which the regulating section has a planar part facing a surface of the electrical connection section except for the raised part.

3. The connector according to claim 1, wherein the terminal insertion hole has a first width measured in the plate thickness direction, the first width is measured at a location spaced away from the regulating section, and each of the first width is greater than the plate thickness.

4. The connector according to claim 3, wherein the terminal insertion hole has a second width measured in the plate thickness direction, the second width is measured at the regulating section, and the second width are greater than the plate thickness.

5. The connector according to claim 4, wherein the second width is less than the first width.

6. The connector according to claim 1, wherein the electrical connection part includes a second raised part spaced from the first raised part, and the first surface extends between the raised part and the second raised part.

7. The connector according to claim 1, wherein the raised part includes a tapered surface at each end of the raised surface, and one of the tapered surfaces extends from the raised surface to the first surface.

* * * * *